US005713397A

United States Patent [19]

Quigley

[11] Patent Number: 5,713,397

[45] Date of Patent: Feb. 3, 1998

[54] MULTI-LAYERED THROUGH AIR DRYING FABRIC

[75] Inventor: Scott Quigley, Townville, S.C.

[73] Assignee: Wangner Systems Corporation, Greenville, S.C.

[21] Appl. No.: 694,743

[22] Filed: Aug. 9, 1996

[51] Int. Cl.[6] ..... D03D 13/00

[52] U.S. Cl. ..... 139/383 A

[58] Field of Search ..... 139/383 A

[56] References Cited

U.S. PATENT DOCUMENTS

| | | | |
|---|---|---|---|
| 3,301,746 | 1/1967 | Sanford et al. | 139/383 A |
| 3,974,025 | 8/1976 | Ayers . | |
| 4,239,065 | 12/1980 | Trokhan . | |
| 4,759,391 | 7/1988 | Waldvogel . | |
| 4,909,284 | 3/1990 | Kositzke | 139/383 A |
| 5,164,249 | 11/1992 | Tyler et al. | 139/383 A |
| 5,169,709 | 12/1992 | Fleischer | 139/383 A |
| 5,324,392 | 6/1994 | Tate et al. | 139/383 A X |
| 5,366,798 | 11/1994 | Ostermayer | 139/383 A |
| 5,421,375 | 6/1995 | Praetzel | 139/383 A |
| 5,429,686 | 7/1995 | Chiu . | |
| 5,456,293 | 10/1995 | Ostermayer . | |
| 5,487,414 | 1/1996 | Kuji et al. | 139/383 A |
| 5,500,277 | 3/1996 | Trakhan . | |
| 5,544,678 | 8/1996 | Barrett | 139/383 A |
| 5,555,917 | 9/1996 | Quigley | 139/383 A |

*Primary Examiner*—Andy Falik
*Attorney, Agent, or Firm*—Cort Flint; Henry Jaudon

[57] ABSTRACT

An imprinting through air multi-layer drying fabric for use with a papermaking machine comprising a plurality of MD (machine direction) yarns forming a continuous loop and a plurality of CMD (cross machine direction yarns) interlacing with said MD yarns and extending in the width direction. The fabric is formed to have a support surface and a machine surface with the machine surface comprising a plurality of load bearing MD yarns arranged side-by-side across the width of the fabric, and interlaced in a first pattern with the CMD yarns to provide an even knuckle distribution over the first layer. The support surface is formed of second plurality of non-load bearing MD yarns arranged side-by-side interlaced with the CMD yarns in s second pattern producing raised MD yarn floats arranged in a staggered arrangement in the MD direction to produce a desired pattern. The floats are capable of imparting selected patterned imprints onto the surface of a paper product supported thereon while passing through the papermaking machine.

20 Claims, 4 Drawing Sheets

MULTI-LAYERED THROUGH AIR DRYING FABRIC

BACKGROUND OF THE INVENTION

The present invention relates to a papermaking fabric and is particularly directed to an embossing fabric for use in the drying section of a papermaking machine.

In the manufacture of through air dried paper products, such as facial tissue and bath tissue, there is always a need to improve the properties of the final product both in texture and appearance. Improved texture relates to elasticity, absorption, flexibility, feel, etc. Improved appearance relates to the immediate impression which results from viewing the product.

Embossing with through air drying fabrics is not of itself novel as various fabrics for this purpose are known. Certain of these fabrics are disclosed in U.S. Pat. Nos. 5,500,277; 5,429,686; and 4,759,391.

The instant invention is an improvement over the various prior art arrangements, providing improved wearability, stability, strength, increased design capability and improved porosity.

The fabric of the instant invention is woven of warp and weft yarns which preferably are comprised of synthetic monofilaments having a circular cross-section. It is well within the scope of the invention to utilize warp and weft yarns of oval or rectangular cross-section in various combinations. In another alternative, the warp and weft may comprise of multifilament yarns.

It is an object of this invention to provide an embossing fabric capable of operating for an increased period of time.

Another object of the invention is the provision of an embossing fabric capable of producing clear and defined impressions in the paper product.

Another object of the invention is to provide an embossing fabric having increased porosity.

Another object of the invention is to provide an embossing fabric having increased stability.

SUMMARY OF THE INVENTION

The instant invention is directed to directed to an imprinting through air multi-layer drying fabric for use with a papermaking machine. The fabric comprises a plurality of MD (machine direction) yarns forming a continuous loop and a plurality of CMD (cross machine direction yarns) interlacing with the MD yarns and extending the width of said fabric. The MD and CMD yarns form a fabric having a support surface and a machine surface.

The machine surface comprises a plurality of MD yarns arranged side-by-side along a first layer and across the width of the fabric. The MD yarns are interlaced in a first pattern with the CMD yarns to provide even knuckle distribution over the entire first layer.

The support surface comprises a plurality of MD yarns arranged side-by-side over the width of the fabric along a second layer and interlaced with the CMD yarns in a second pattern producing raised MD yarn floats along a support surface. The floats are staggered as desired across the surface and in the MD direction to produce selected imprinting patterns. The arranged floats are capable of imparting selected patterned imprints onto the surface of a paper product passing through said papermaking machine.

There are an equal number of MD yarns in each of the first and second layers. In the second layer, the MD yarns extend along the fabric length vertically positioned above the MD yarns of the first layer. The CMD yarns are arranged in both the upper and lower layers. The CMD yarns of the upper layer interlace only with the MD yarns of the upper layer while the CMD yarns of the lower layer interlace with the MD yarns of both the upper and lower layers. The mode of interlacing comprises weaving and the MD yarns are the warp yarns and the CMD yarns are the weft yarns.

A woven multilayered imprinting fabric for use with a papermaking machine comprised of a pair both warp and weft systems. The first warp system consists of a plurality of first warp yarns arranged side-by-side across the width of the fabric. These first warp yarns are a non load bearing raised pattern effecting system. The second warp system comprising a plurality of second warp yarns arranged side-by-side across the width of the fabric and constitute the load bearing system of the fabric.

A weft system, comprising a plurality of weft yarns, weaves with the yarns of the first and second warp systems in a balancing weave pattern which maintains the yarns of the first and second warp systems relatively positioned along the length of the fabric. The weft system weaves with the warp yarns of the first warp system in a first pattern and with the warp yarns of the second warp system in a second pattern. The first weave pattern produces successive warp direction floats which extend first over and then under a plurality of weft yarns. When extending over the weft yarns, the warp yarn floats are raised to lie above the plane of the weft yarn knuckles on that surface. The warp yarn floats are staggered across the width of the fabric to produce desired patterns. Preferably a majority of the warp yarn floats are of equal length.

The second weave pattern weaves with the second warp system and is a plane weave. This is the load bearing weave.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
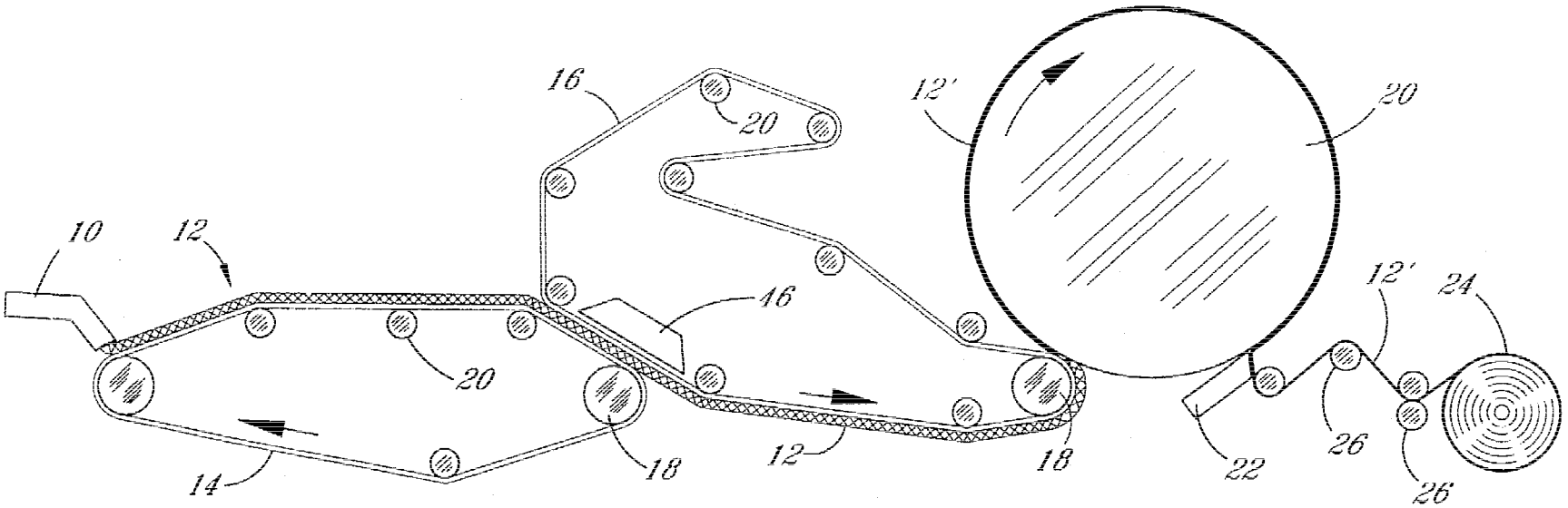
FIG. 1 is a schematic flow diagram of a papermaking machine with which the fabric of the invention may be used.

Turning now to the drawings, FIG. 1 shows a schematic of an arrangement of a papermaking machine with which the instant fabric may operate. As shown, head box 10 delivers paper pulp or paper forming fibers 12 onto forming fabric 14 which is traveling in a clockwise direction as indicated by the arrow. The paper forming fibers are passed through a suction section which includes suction box 16 where they pass from forming fabric 14 onto embossing fabric 16 by press roll 18. The embossing fabric carries paper forming fibers 12 in the direction of the arrow to heated drying drum 20. Here a second press roll 18 transfers paper forming fibers 12 onto drum 20 where they are further dried and form paper. Paper 12' is removed from drum 20 by scraper 22 and wound into roll 24. A variable number of idler rolls 26 deliver paper 12' from drum 20 to roll 24. Endless fabrics 14 and 16 are located and supported by idler rolls 20. It is noted that in certain arrangements the embossing fabric may also be the forming fabric.

Figure 2:
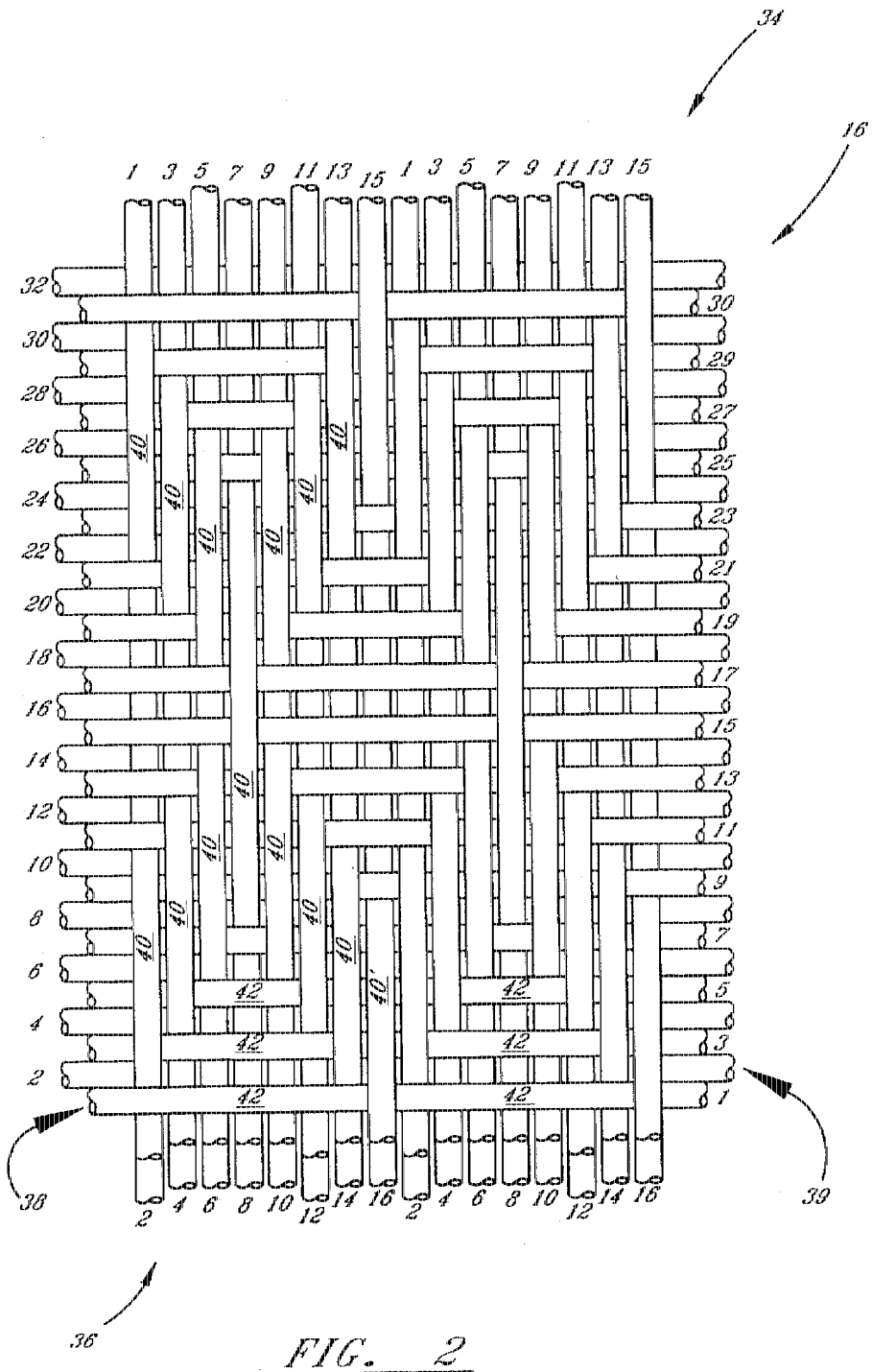
FIG. 2 is a top sectional view showing the patterned embossing floats of the support and embossing surface of the fabric of the invention.
Figure 4:
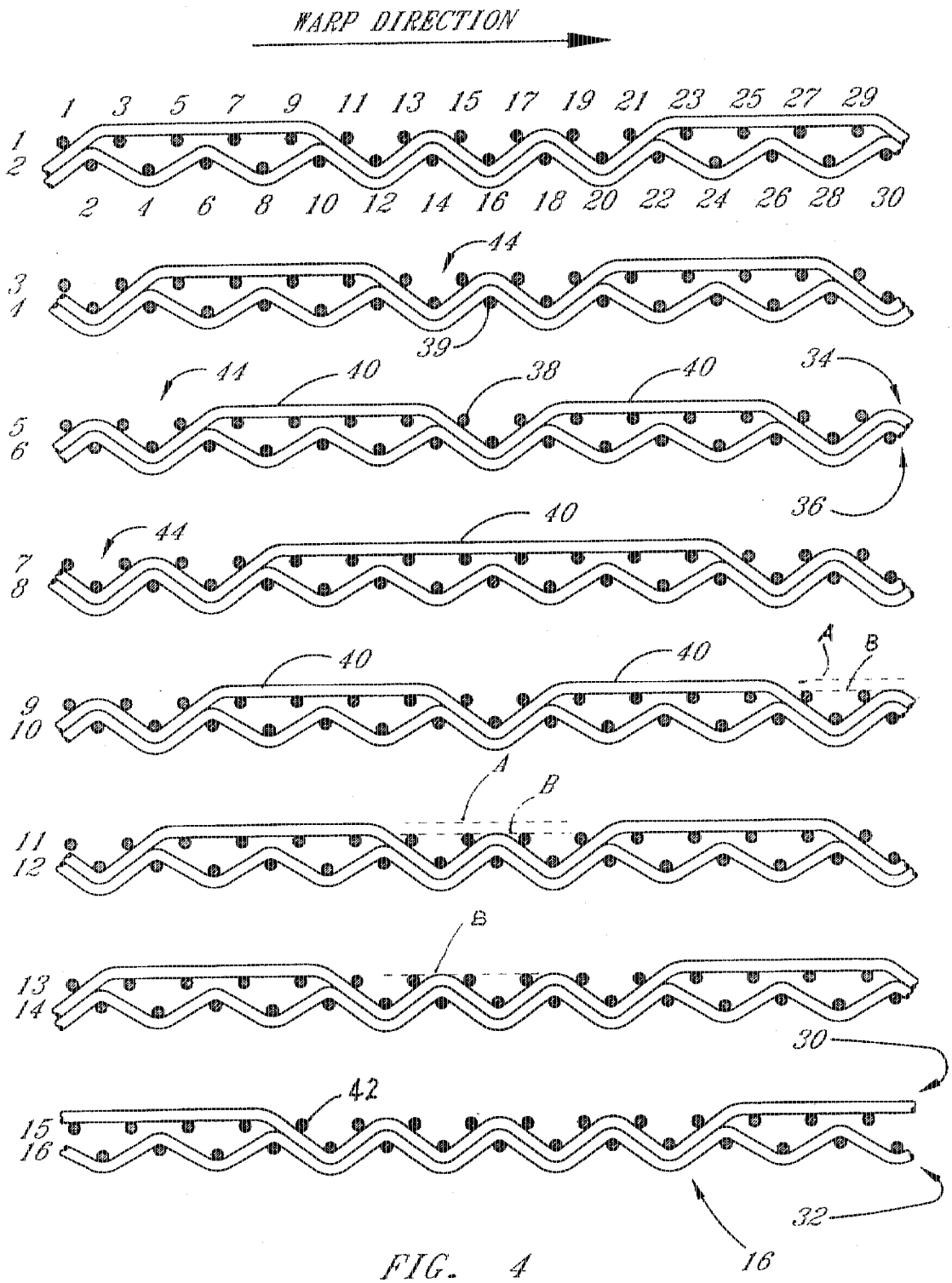
FIG. 4 is a sectional side view showing a full repeat of the weave pattern of the fabric of the invention.

Turning now to FIGS. 2 and 4, a detailed structure of the embossing fabric of the invention is shown. FIG. 2 shows the support surface of fabric 16 in a full weft wise repeat of the weave pattern and two full repeats warp wise. FIG. 4 is a sectioned side view which shows the interrelationship of upper and lower warp yarns 34, 36 with upper and lower weft yarns 38, 40 through a single repeat of the weave pattern.

Fabric 16 is comprised of an upper paper fiber support layer 30 which includes a support surface and a lower layer 32 which includes a machine contacting surface. The fabric is woven with upper warp yarns 34 of the upper layer weaving primarily with upper weft yarns 38 and lower warp yarns 36 of the lower layer weaving only with lower weft yarns 40. There are sixteen warp yarns and thirty weft yarns per pattern repeat. These yarns are inserted as successive picks numbered 1–16 and arranged warp yarns numbered 1–32 indicating their sequence in the pattern.

Support surface 34 is formed by picks (1, 3, 5, 7, 9, 11, 13, 15, 17, 19, 21, 23, 25, 27, and 29) of upper weft yarns 38 weaving with arranged warp yarns (1, 3, 5, 7, 9, 11, 13, and 15) of upper warp yarns 34 to form a series of warp direction embossing floats 40 and a series of weft floats 42. The warp tension is controlled in known manner to bring the upper surface of embossing floats 40 to extend along plane A which lies above plane B formed by the upper surface of weft floats 42. The length, in the fabric direction, and the position across the fabric width of each of embossing floats 40 is controlled as desired to produce the desired pattern.

FIG. 4 shows the pattern forming two rows of embossing floats 40 arranged in diverging and converging locations across the fabric width. At the center of the weave pattern floats 40 converge connecting the two rows with a single elongated float 40'. Obviously, the locations of the floats may be arranged to create any desired pattern. Floats 40 may pass over as few as two consecutive weft yarns and as many as twenty.

The upper surface of warp yarns 34 along floats 40 lie along plane A while the upper surface of weft yarns 38 at the knuckle passing over warp yarns 34 lie along plane B. The spacing between planes A and B may range between 30 and 150% of the diameter of warp 34. Preferably, the spacing between planes A and B is approximately 80% of the diameter.

FIG. 4 shows upper fabric layer 30 weaving independently of lower fabric layer 32 except at selected tie points, indicated at 44, where upper warp yarn 34 is controlled to weave under a lower weft yarn 39. Selected examples are shown with arranged warp yarn 1 weaving under picks 12, 16, and 20 and arranged warp yarn 3 weaving under picks 2, 14, 18, and 30.

As seen in FIGS. 2 and 4, upper weft yarn 38 weaves exclusively with upper warp yarn 34 to form a series of weft floats 42 which extend in selected lengths in the width direction of the fabric, the length being controlled by the length of the embossing warp floats 40. Upper weft 38 also weaves to pass beneath upper warp 34 to form the warp floats 40.

Lower fabric layer 32 is woven in a plain weave with lower weft yarns 39 weaving exclusively with lower warp yarns 36 with the exception of the above referred to tie points 44. This weave pattern produces a plurality of successive knuckles in lower warp yarns 36 and lower weft yarns 39 which are evenly distributed over the entire machine surface, as shown in FIG 4. Lower layer 32 forms the load bearing layer of fabric 16 and as such controls the fabric stability in both the warp and weft directions. This is achieved primarily because of the stability of a plain weave.

Warp yarns 34, 36 are arranged in vertical alignment or in stacked relationship across the width and along the length of the fabric. This formation allows a maximum of open space between adjacent warp yarns with respect to the total number of warp yarns or the warp count. Stacking also arranges both warp yarns 34, 36 in the same space widthwise of a single yarn. Stacking allows for an increase in the number or size of the warp yarns providing increased fabric stability and wearability without sacrificing porosity.

The weft yarn 38, 39 is woven with the warp yarn 34, 36 in a balancing weave pattern, i.e. one which maintains the warp yarns in their respective stacked positions with the fabric in use.

Figure 3:
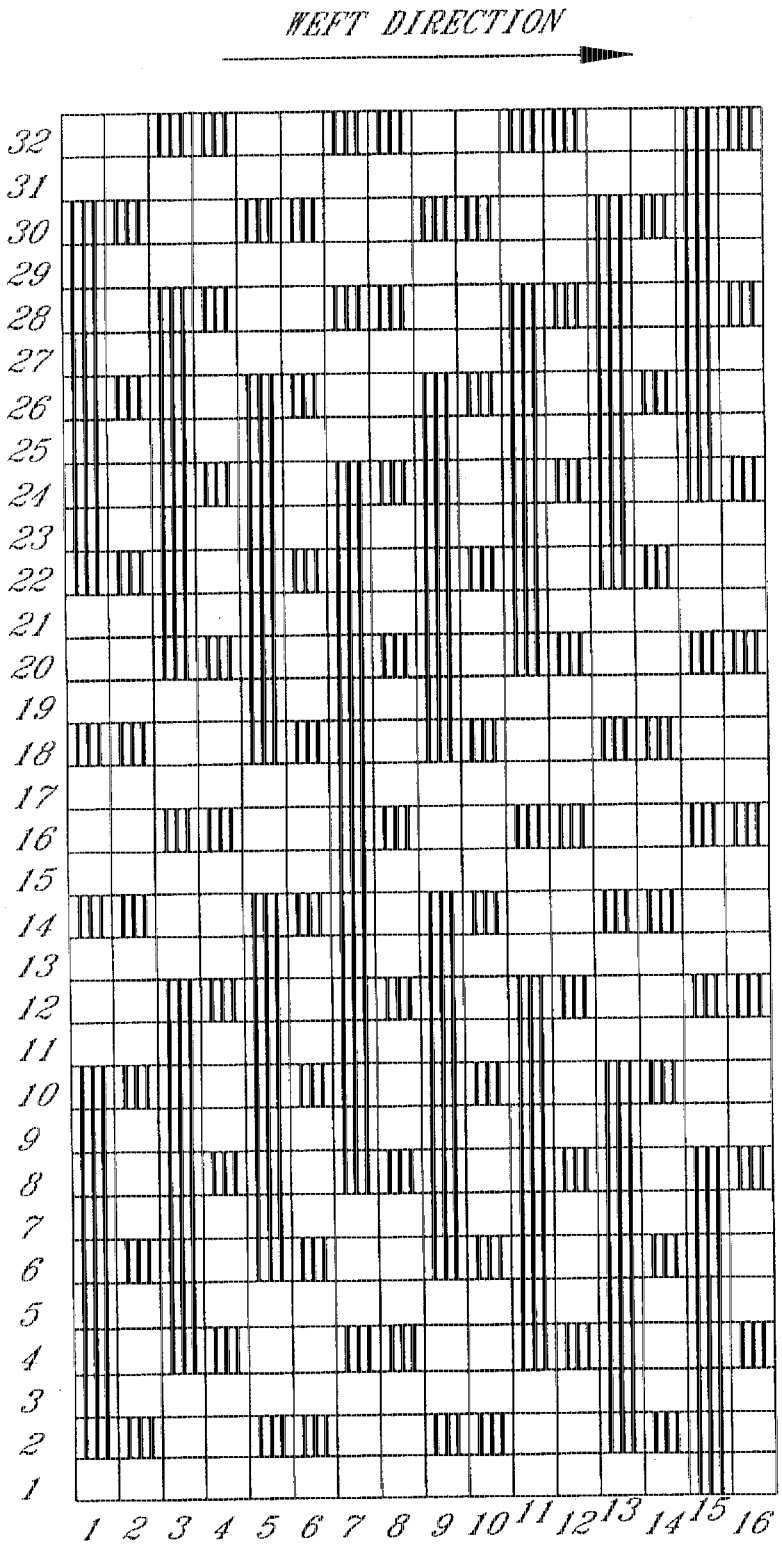
FIG. 3 is the weave diagram of a repeat of the weave pattern.

FIG. 3 shows the weave diagram for the fabric of the invention. As shown, a repeat of the weave pattern includes 16 warp yarns and 32 weft yarns interwoven to produce the fabric as described.

The fabric is woven to have a porosity of between 600 to 900 CFM with a preferred porosity of about 750 CFM. The warp and weft density may range between 5 to 100 per inch for each fabric layer. Upper warp yarns 34 may have a diameter or height slightly larger than lower weft yarn 39 or upper and weft 38, 39. Lower warp yarns 36 may be the same size or larger than lower weft 39 but should not be larger than upper warp yarns 34. The warp yarns may be circular, oval or rectangular in cross-section. The warp yarns of each layer may be the same or different as may be the warp yarns between layers. Preferably the fabric forming yarns are polyester, however, may dimensionally stable heat resistant synthetic yarn could be used.

While a preferred embodiment of the invention has been described using specific terms, such description is for illustrative purposes only, and it is to be understood that changes and variations may be made without departing from the spirit or scope of the following claims.

What is claimed is:

1. An imprinting through air multi-layer drying fabric for use with a papermaking machine, said fabric comprising:

a plurality of MD (machine direction) yarns forming a continuous loop and a plurality of CMD (cross machine direction yarns) interlacing with said MD yarns and extending the width of said fabric, said MD and CMD yarns forming a fabric having a support surface and a machine surface;

said machine surface comprising a plurality of said MD yarns arranged side-by-side along a first layer and across the width of said fabric, said CMD yarns being interlaced in a first pattern with said MD yarns to provide an even knuckle distribution over said first layer;

said support surface comprising a plurality of said MD yarns arranged side-by-side along a second layer and interlaced with said CMD yarns in a second pattern producing raised MD yarn floats along said second layer, said floats being staggered in the MD direction to produce specific patterns;

said raised and staggered floats being capable of imparting imprints of said specific patterns onto the surface of a paper product passing through said papermaking machine.

2. The fabric of claim 1 wherein said MD yarns of said second layer extend side-by-side over the fabric width.

3. The fabric of claim 1 wherein these are an equal number of MD yarns in said first and second layers.

4. The fabric of claim 1 wherein said second layer of MD yarns extend along said continuous loop vertically of said MD yarns of said first layer.

5. The fabric of claim 1 wherein said CMD yarns include first layer CMD yarns and second layer CMD yarns, with said second layer CMD yarns interlacing only with said MD yarns of said second layer.

6. The fabric of claim 5 wherein said CMD yarns of said first layer interlace with said MD yarns of both said first and second layers.

7. The fabric of claim 1 wherein said interlacing comprises weaving.

8. The fabric of claim 1 wherein said second layer MD yarns never appear on said machine surface.

9. The fabric of claim 1 wherein said MD yarns are warp yarns and said CMD yarns are weft yarns.

10. A woven multilayered imprinting fabric for use in the dryer section of a papermaking machine comprising:

a first warp system comprising a plurality of first warp yarns arranged side-by-side across the width of the fabric, said first warp yarn system being a non load bearing raised pattern effecting system and forming a first layer of said multilayered fabric;

a second warp system comprising a plurality of second warp yarns arranged side-by-side across the width of the fabric, said second warp yarn system being a load bearing system and forming a second layer of said multilayered fabric, said first and second warp being vertically stacked along the length of the fabric; and a weft system comprising a plurality of weft yarns weaving with said first and second warp yarns in a balancing weave pattern to maintain said first and second warp yarns in stacked condition along the length of the fabric.

11. The fabric of claim 10 wherein said weft system weaves with said first warp yarns in a first pattern and with said second warp yarns in a second pattern.

12. The fabric of claim 11 wherein said first pattern provides successive warp yarn floats which extend first over and then under a plurality of weft yarns of said weft yarn system.

13. The fabric of claim 12 wherein said weft yarns of said weft yarn system are arranged along substantially a first plane and said warp yarn floats passing over said plurality of weft yarns lie along a plane above said first plane.

14. The fabric of claim 12 wherein said warp yarn floats over said weft yarns are staggered across the width of said fabric producing specific patterns.

15. The fabric of claim 12 wherein said warp yarn floats over said weft yarns are of equal length.

16. The fabric of claim 11 wherein said second pattern is a plain weave.

17. The fabric of claim 10 wherein said fabric includes an imprinting surface which supports and imprints paper forming matter during operation of said papermaking machine and a machine surface which only contacts the papermaking machine during operation;

said first, warp yarn system and said weft yarn system are woven to form said imprinting surface; and said second warp yarn system and said weft yarn system are woven to form said machine surface.

18. The fabric of claim 17 wherein yarns of said first warp yarn system never appear on said machine surface and said yarns of said second warp yarn system never appear on said imprinting surface.

19. The fabric of claim 17 wherein said weft yarn system comprises an upper layer of weft yarns and a lower layer of weft yarns.

20. The fabric of claim 19 wherein yarns of said upper layer of weft yarns never appear on said machine surface.

* * * * *